US008666272B2

(12) United States Patent
Kobayashi et al.

(10) Patent No.: US 8,666,272 B2
(45) Date of Patent: Mar. 4, 2014

(54) FIXING DEVICE AND IMAGE FORMING APPARATUS

(75) Inventors: Yasuyuki Kobayashi, Ebina (JP); Kouichi Imazu, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 308 days.

(21) Appl. No.: 13/111,536

(22) Filed: May 19, 2011

(65) Prior Publication Data

US 2012/0114343 A1 May 10, 2012

(30) Foreign Application Priority Data

Nov. 8, 2010 (JP) ..... 2010-249634

(51) Int. Cl.
*G03G 15/20* (2006.01)
*G03G 15/00* (2006.01)

(52) U.S. Cl.
USPC ..... 399/67; 399/43; 399/328; 399/330

(58) Field of Classification Search
USPC ..... 399/43, 45, 67, 328, 330
See application file for complete search history.

(56) References Cited

U.S. PATENT DOCUMENTS

| | | | | |
|---|---|---|---|---|
| 4,920,250 | A * | 4/1990 | Urban | 399/328 X |
| 7,058,329 | B2 * | 6/2006 | Takahashi | 399/328 X |
| 7,613,411 | B2 * | 11/2009 | Tateishi et al. | 399/43 X |
| 7,653,322 | B2 * | 1/2010 | Maeda et al. | 399/67 X |
| 7,684,746 | B2 * | 3/2010 | Asakura et al. | 399/330 |
| 7,783,218 | B2 * | 8/2010 | Maeda et al. | 399/328 X |

FOREIGN PATENT DOCUMENTS

JP 2001-175119 A 6/2001

* cited by examiner

*Primary Examiner* — Sandra Brase
(74) *Attorney, Agent, or Firm* — Sughrue Mion, PLLC

(57) ABSTRACT

A fixing device includes a fixing member, a pressing member, a heating member, a movement mechanism, and a control unit. The fixing member fixes a toner image onto a recording material. The pressing member is pressed against an outer circumferential surface of the fixing member to form a fixing pressure part between the pressing member and the fixing member. The heating member heats the outer circumferential surface of the fixing member. The movement mechanism moves the heating member to contact with and be apart from the fixing member. The control unit controls the movement mechanism to move the heating member relatively apart from the fixing member after a predetermined time elapses after a trailing end of a recording material in a transport direction thereof passes through the fixing pressure part each time when a recording material passes through the fixing pressure part.

4 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2010-249634 filed Nov. 8, 2010.

BACKGROUND (i) Technical Field

The present invention relates to a fixing device and an image forming apparatus.

(ii) Related Art

In electrophotographic image forming apparatuses such as copiers and printers, for example, a drum-shaped photoconductor is uniformly charged, and the charged photoconductor is exposed to light that is controlled based on image information to form an electrostatic latent image on the photoconductor. The electrostatic latent image is developed into a visible image (toner image) using toner, and the toner image is transferred onto a recording material and is fixed by a fixing device to form an image.

SUMMARY

According to an aspect of the invention, there is provided a fixing device including a fixing member, a pressing member, a heating member, a movement mechanism, and a control unit. The fixing member fixes a toner image onto a recording material. The pressing member is pressed against an outer circumferential surface of the fixing member to form a fixing pressure part between the pressing member and the fixing member, and a recording material that has an unfixed toner image held thereon passes through the fixing pressure part. The heating member heats the outer circumferential surface of the fixing member. The movement mechanism moves the heating member to contact with and be apart from the fixing member. The control unit controls the movement mechanism to move the heating member relatively apart from the fixing member after a predetermined time elapses after a trailing end of the recording material in a transport direction thereof passes through the fixing pressure part each time when a recording material passes through the fixing pressure part.

BRIEF DESCRIPTION OF THE DRAWINGS

Exemplary embodiment(s) of the present invention will be described in detail based on the following figures, wherein.

DETAILED DESCRIPTION

Exemplary embodiments of the present invention will be described in detail hereinafter with reference to the drawings.

An exemplary embodiment will be described in detail hereinafter with reference to the drawings.

Figure 1:
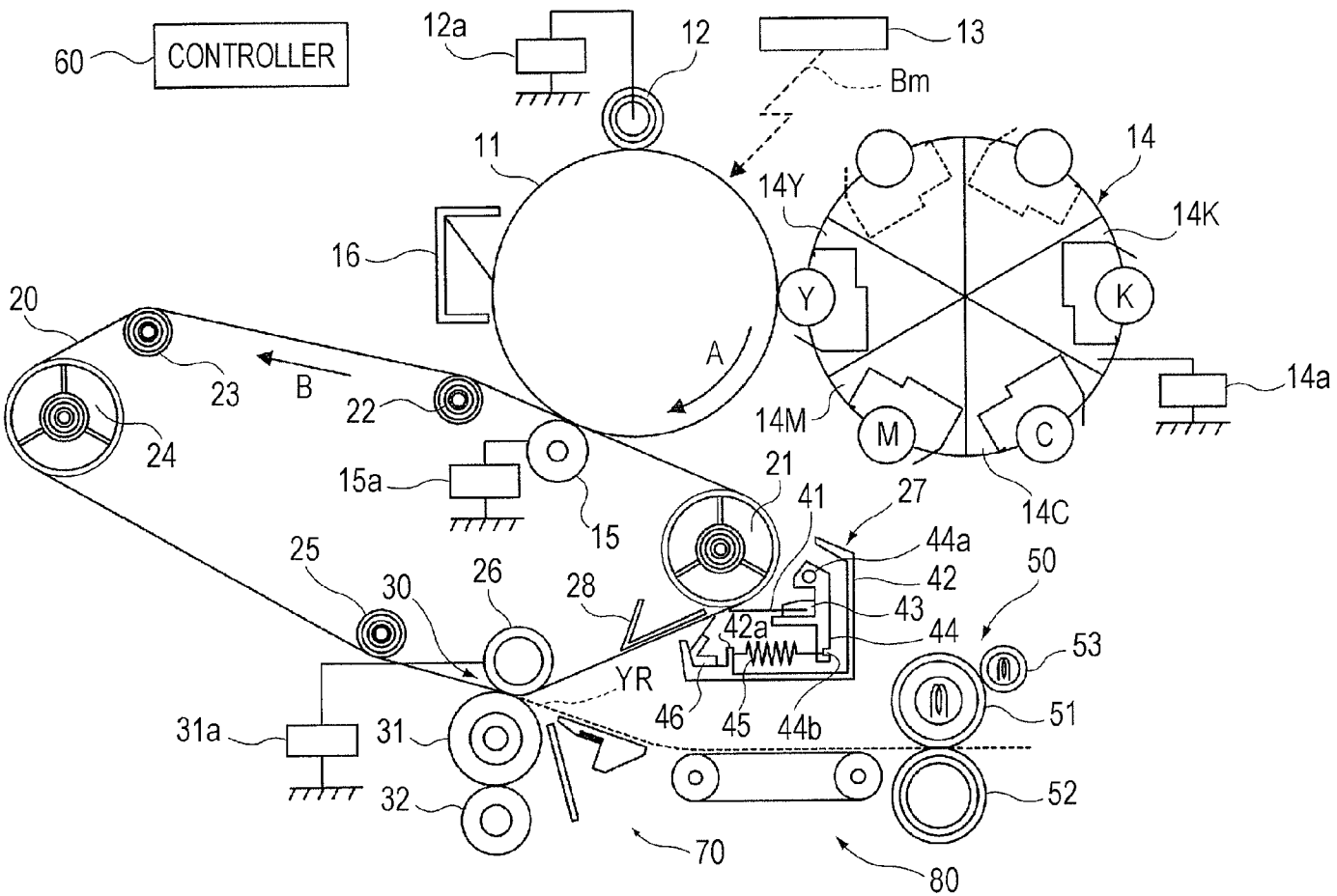
FIG. 1 illustrates a schematic configuration of an image forming apparatus according to an exemplary embodiment.

FIG. 1 illustrates a schematic configuration of an image forming apparatus 1 according to this exemplary embodiment.

The image forming apparatus 1 according to this exemplary embodiment includes a photoconductor drum 11 serving as an image holding member disposed so as to be rotatable in the direction indicated by the arrow A, and an intermediate transfer belt 20 serving as a transfer member disposed so as to be rotatable in the direction indicated by the arrow B so that toner images of respective color components formed on the photoconductor drum 11 are sequentially transferred (first-transferred) onto the intermediate transfer belt 20 and held thereon. The image forming apparatus 1 further includes a second transfer unit 30 configured to collectively transfer (second-transfer) the superimposed toner images, which have been transferred onto the intermediate transfer belt 20, onto a sheet of paper P serving as a recording material, and a fixing unit 50 as an example of a fixing device that fixes the second-transferred toner images onto the sheet of paper P. The image forming apparatus 1 further includes a controller 60 that controls individual mechanism units of the image forming apparatus 1, a charge eraser 70 as an example of a charge erasing device that erases the electric charge built up on the sheet of paper P by the second transfer unit 30, and a transporting unit 80 that transports the sheet of paper P from the second transfer unit 30 to the fixing unit 50.

Electrophotographic devices are disposed in sequence around the photoconductor drum 11. Examples of the electrophotographic devices include a charging roller 12, a laser exposure unit 13, a rotary developing device 14, a first-transfer roller 15, and a cleaning blade 16. The charging roller 12 serves as a contact charging member that charges the photoconductor drum 11. The laser exposure unit 13 (in FIG. 1, exposure beam is represented by Bm) serves as a toner image forming section configured to write an electrostatic latent image on the photoconductor drum 11. In the rotary developing device 14, developing units 14Y, 14M, 14C, and 14K that contain toners of yellow (Y), magenta (M), cyan (C), and black (K) color components, respectively, and that develops the electrostatic latent image on the photoconductor drum 11 into a visible image using the toners are mounted in a rotatable manner. The first-transfer roller 15 serves as a transfer unit that transfers the toner images of the respective color components formed on the photoconductor drum 11 onto the intermediate transfer belt 20. The cleaning blade 16 collects toner charged with a polarity opposite to the normal charging polarity, which is included in residual toner on the photoconductor drum.

Here, the charging roller 12 may be made by forming an epichlorohydrin rubber layer on a surface of a metal shaft and then coating a surface of the epichlorohydrin rubber layer with a polyamide layer of about 3 μm containing tin oxide conductive powder.

The photoconductor drum 11 is made by forming an organic photosensitive layer on a surface of a metal thin cylindrical drum, and the organic photosensitive layer is made of a material charged negatively. The development with the developing units 14Y, 14M, 14C, and 14K is reversal development. Therefore, the toners used by the developing units 14Y, 14M, 14C, and 14K are negatively charged toners. The charging roller 12 is connected to a charging bias power supply 12*a* that applies a predetermined charging bias. The rotary developing device 14 is connected to a developing bias power supply 14*a* that applies a predetermined developing bias to the developing units 14Y, 14M, 14C, and 14K. The first-transfer roller 15 is connected to a first-transfer bias power supply 15*a* that applies a predetermined first-transfer bias. A developing device drive motor (not illustrated) is also attached to the rotary developing device 14 that rotates to drive a predetermined developing unit to face the photoconductor drum 11. The photoconductor drum 11 is grounded. In the image forming apparatus 1 according to this exemplary embodiment, the photoconductor drum 11, the charging roller 12, the laser exposure unit 13, and the rotary developing device 14 may be used as a toner image forming unit that forms a toner image.

The intermediate transfer belt 20 is arranged so as to be stretched over multiple (in this exemplary embodiment, six) rollers 21 to 26. Among them, the rollers 21 and 25 are driven rollers, the roller 22 is a metal idle roller used for positioning the intermediate transfer belt 20 or for forming a flat first-transfer surface, and the roller 23 is a tension roller used for keeping the tension of the intermediate transfer belt 20 uniform. Further, the roller 24 is a driving roller of the intermediate transfer belt 20, and the roller 26 is a backup roller used in the second-transfer operation, described below. The intermediate transfer belt 20 may be made by adding a certain amount of carbon black as conductive agent to resin such as polyimide resin, polycarbonate resin, polyester resin, polypropylene resin, polyethylene terephthalate resin, acrylic resin, or vinyl chloride resin, various rubbers, or the like, and may have a surface resistivity of $10^{11}$ ohms/square, a volume resistivity of $10^{11}$ Ω·cm, and a thickness of 150 μm.

The second transfer unit 30 includes a second-transfer roller 31 arranged on a surface of the intermediate transfer belt 20 on which a toner image is held (the surface will be sometimes hereinafter referred to as an "image holding surface"), the roller 26, a cleaning roller 32 that removes residual toner and the like on the second-transfer roller 31, and any other suitable device. The surface of the roller 26 may be formed of a tube of ethylene-propylene diene monomer/nitrile butadiene rubber (EPDM/NBR) blend rubber having carbon dispersed therein, and an inner portion of the roller 26 may be formed of an EPDM rubber. Further, the roller 26 may be formed so as to have a surface resistivity of 7 to 10 log ohms/square, and the hardness may be set to, for example, 70° (Asker C). The roller 26 is connected to a second-transfer bias power supply 31*a* that applies a predetermined second-transfer bias, and the second-transfer roller 31 is grounded.

A belt cleaner 27 serving as a cleaner that removes residual toner attached to the intermediate transfer belt 20 obtained after the second-transfer operation is provided downstream the second transfer unit 30, and a sheet metal member 28 is arranged along the inner surface of the intermediate transfer belt 20 so as to face the belt cleaner 27 with the intermediate transfer belt 20 held therebetween. The belt cleaner 27 includes a scraper 41 which may be formed of a stainless plate or the like and which are disposed on the image holding surface of the intermediate transfer belt 20, and a cleaner housing 42 that accommodates the scraper 41. One end of the scraper 41 is pinched in a block 43 and thus fixed thereto, and the block 43 is attached to a holder 44 that swings about a shaft 44*a*. A spring 45 that biases the scraper 41 toward the intermediate transfer belt 20 is attached between a recess portion 44*b* formed in a lower end portion of the holder 44 and a projecting portion 42*a* formed in the bottom portion of the cleaner housing 42. A film seal 46 configured to prevent or reduce scattering of foreign matter that has been removed to outside the belt cleaner 27 is mounted upstream in the movement direction of the intermediate transfer belt 20 as viewed from the scraper 41.

A cam (not illustrated) connected to a cleaner drive motor (not illustrated) allows the holder 44 to be biased or unbiased in the direction opposite to the direction in which the spring 45 is biased, and therefore the scraper 41 may be brought into contact with and separated from the intermediate transfer belt 20. In this exemplary embodiment, in order to form a color image of multiple colors, the second-transfer roller 31 and the belt cleaner 27 are separated from the intermediate transfer belt 20 until the toner image of the color preceding the last color has passed the second-transfer roller 31 and the belt cleaner 27. In the image forming apparatus 1 according to this exemplary embodiment, the intermediate transfer belt 20, the first-transfer roller 15, and the second-transfer roller 31 form a transfer unit that transfers toner images onto paper.

Figure 2:
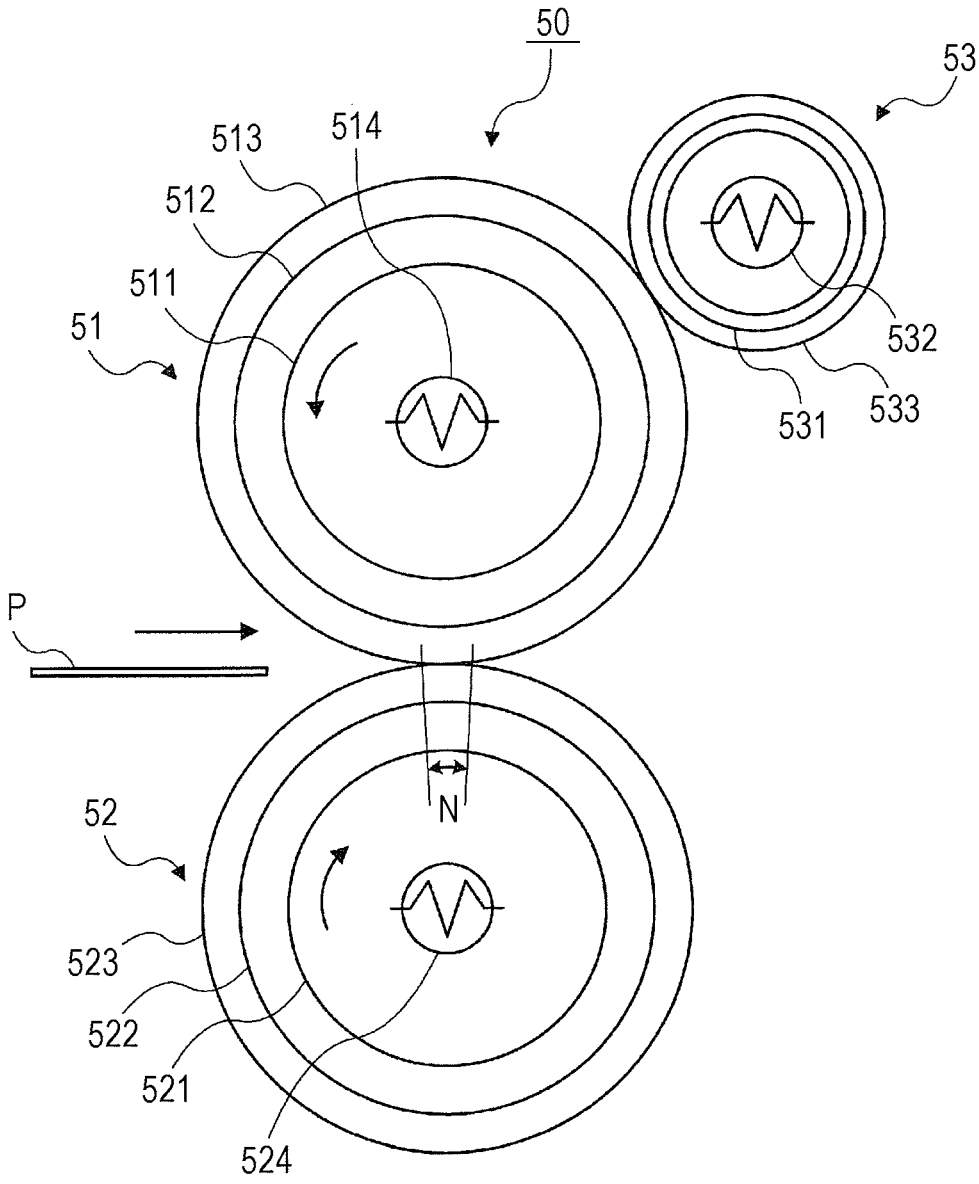
FIG. 2 illustrates a fixing unit according to this exemplary embodiment.

FIG. 2 illustrates the fixing unit 50 according to this exemplary embodiment.

The fixing unit 50 illustrated in FIG. 2 includes a heating roller 51 as an example of a fixing member that fixes a toner image onto paper P, and a pressing roller 52 as an example of a pressing member that is pressed against the outer circumferential surface of the heating roller 51 to form a fixing pressure part (nip part N) between the pressing roller 52 and the heating roller 51, through which the paper P having an unfixed toner image held thereon passes. The fixing unit 50 further includes an external heating roller 53 as an example of a heating member that heats the outer circumferential surface of the heating roller 51. The external heating roller 53 is provided so as be capable of coming into contact with and separating from the heating roller 51.

The heating roller 51 may be formed by, for example, forming an aluminum or steel use stainless (SUS) cylindrical roller 511 as a base and by stacking an elastic layer 512 made of silicone rubber and a release layer 513 formed of a tetrafluoroethylene-perfluoro (alkyl vinyl ether) copolymer (PFA) tube in this order from the base side. The heating roller 51 is driven by a drive unit such as a motor (not illustrated) to rotate in the arrow direction.

A halogen heater 514 serving as a heat source that generates heat necessary for the fixing operation is disposed in the heating roller 51. In accordance with a value measured by a temperature sensor (not illustrated) disposed so as not to be in contact with a surface of the heating roller 51, a processing unit (not illustrated) disposed in the fixing unit 50 controls the surface temperature of the heating roller 51 to a predetermined set temperature.

The pressing roller 52 may be a member pressed against the outer circumferential surface of the heating roller 51 to form the nip part N between the pressing roller 52 and the heating roller 51, through which the paper P having an unfixed toner image held thereon passes. In accordance with the rotation of the heating roller 51, the pressing roller 52 rotates in the arrow direction.

Like the heating roller 51, the pressing roller 52 may be formed by forming an aluminum or SUS cylindrical roller 521 as a base and by stacking an elastic layer 522 made of silicone rubber and a release layer 523 formed of a PFA tube in this order from the base side. A halogen heater 524 serving as a heat source that generates heat necessary for the fixing operation is disposed in the heating roller 51. In accordance with a value measured by a temperature sensor (not illustrated) disposed so as not to be in contact with a surface of the pressing roller 52, the processing unit (not illustrated) disposed in the fixing unit 50 controls the surface temperature of the pressing roller 52 to a predetermined set temperature.

The external heating roller 53 may be composed of an aluminum or SUS cylindrical roller 531 and a release layer 533 formed of PFA coating. A halogen heater 532 that supplies heat to the outer circumferential surface of the heating roller 51 is disposed in the external heating roller 53. Further, in accordance with a value measured by a temperature sensor (not illustrated) disposed so as to be in contact with a surface of the external heating roller 53, the processing unit (not illustrated) disposed in the fixing unit 50 controls the surface temperature of the external heating roller 53 to a predetermined set temperature.

Further, the external heating roller 53 has a movement mechanism (not illustrated), and is capable of coming into contact with and separating from the heating roller 51.

Figure 3A:
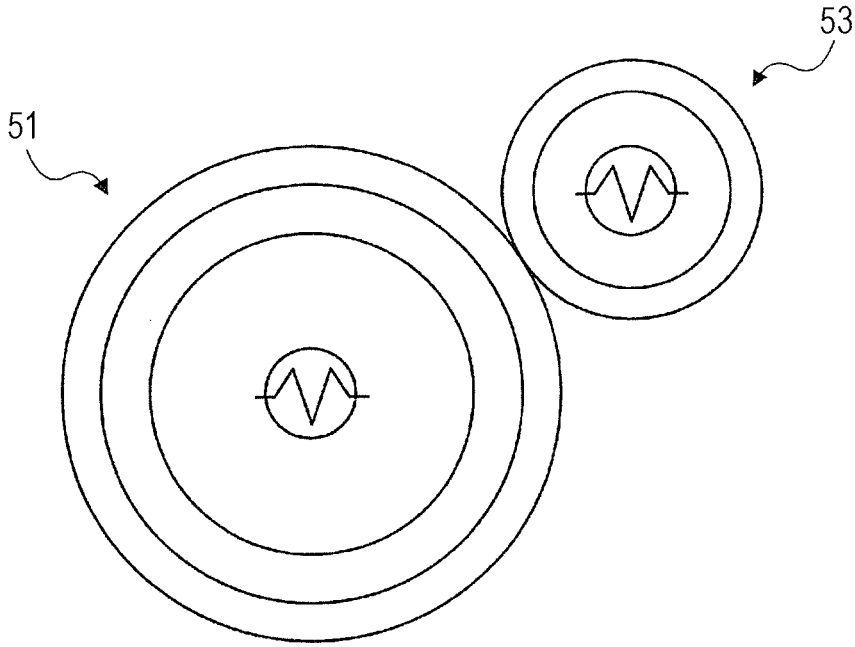
FIGS. 3A and 3B illustrate the states where an external heating roller and a heating roller come into with each other and separate from each other.
Figure 3B:
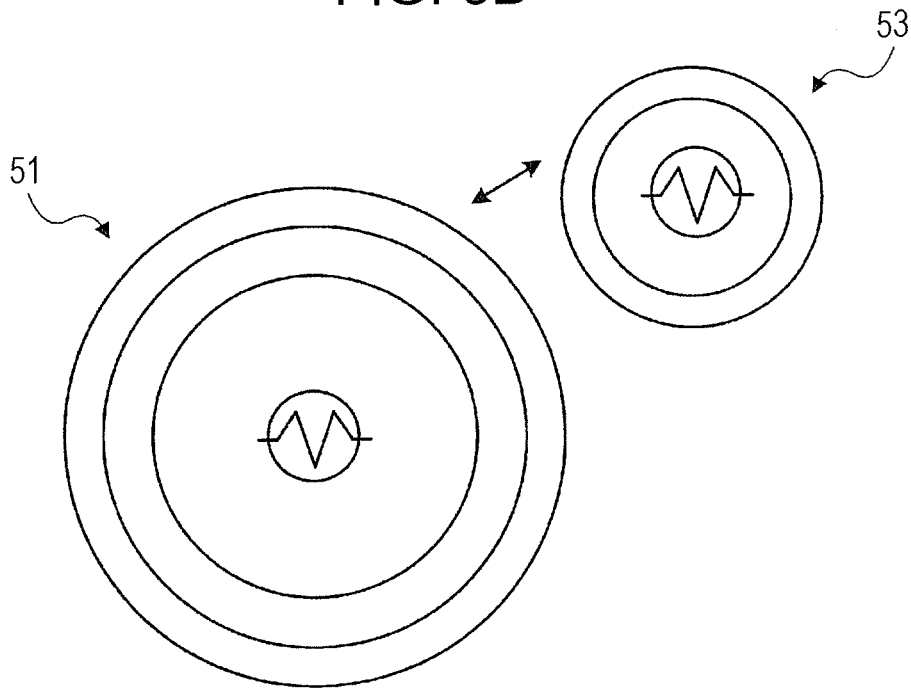

FIGS. 3A and 3B illustrate the states where the external heating roller 53 and the heating roller 51 come into contact with each other and separate from each other. FIG. 3A illustrates the state where the external heating roller 53 comes into contact with the heating roller 51, and FIG. 3B illustrates the state where the external heating roller 53 separates from the heating roller 51.

In this exemplary embodiment, the external heating roller 53 is repeatedly brought into contact with the heating roller 51 and separated from the heating roller 51, thus preventing or reducing the variation in temperature or the changes in temperature of the outer circumferential surface of the heating roller 51. The timing at which the external heating roller 53 comes into contact with and separates from the heating roller 51 may be controlled by the processing unit in the fixing unit 50.

However, if the timing at which the external heating roller 53 is separated from the heating roller 51 is not appropriate, the temperature of the outer circumferential surface of the heating roller 51 may change, and a difference in glossiness may occur between images to be formed.

In this exemplary embodiment, the changes in temperature of the outer circumferential surface of the heating roller 51 may be prevented or reduced by controlling the timing at which the external heating roller 53 is separated from the heating roller 51 in the following manner.

Figure 4:
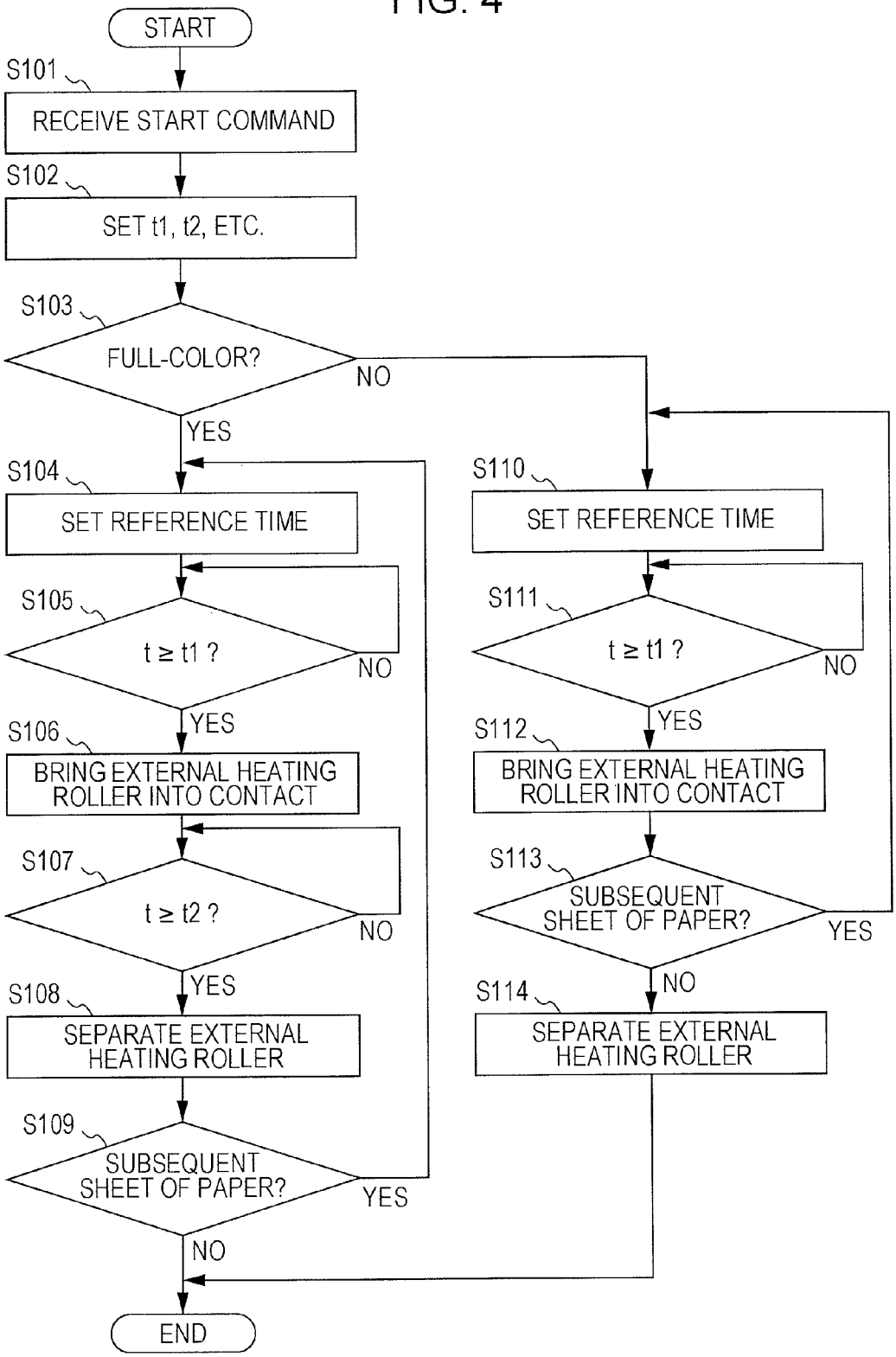
FIG. 4 is a flowchart illustrating a first control example for bringing the external heating roller into contact with the heating roller and separating the external heating roller from the heating roller.

FIG. 4 is a flowchart illustrating a first control example for bringing the external heating roller 53 into contact with the heating roller 51 and separating the external heating roller 53 from the heating roller 51.

First, the controller 60 (see FIG. 1) of the image forming apparatus 1 (see FIG. 1) transmits a start command for starting the formation of an image to the processing unit in the fixing unit 50, and the processing unit receives the start command (step 101). The start command includes, for example, the kind of the paper P (paper type), whether the toner image to be fixed is full-color (FC) or black and white (B/W), the number of sheets (the total number of sheets being transported) of paper P fed to the fixing unit 50, and any other suitable information. Then, the processing unit sets the speed at which the fixing process is performed, and times t1, t2, etc., described below, in accordance with the above information (step 102). Then, the processing unit determines whether the toner image to be fixed is full-color or black and white (step 103). If the toner image is full-color (YES in step 103), the processing unit controls the external heating roller 53 in the following manner.

The processing unit starts the fixing process, and sets a reference time, that is, t=0 (step 104). Examples of the reference time include a time when the leading end of the paper P in the transport direction thereof enters the nip part N. Then, the processing unit determines whether or not an amount of time greater than or equal to time t1 has elapsed since the reference time (t≥t1) (step 105). If an amount of time greater than or equal to time t1 has elapsed, the processing unit performs control to bring the external heating roller 53 into contact with the heating roller 51 (step 106).

In this exemplary embodiment, the time t1 may be a time taken for a portion of the heating roller 51 that is in contact with the paper P when the leading end of the paper P in the transport direction thereof enters the nip part N to rotate one turn and further rotate to reach the position of the external heating roller 53. That is, in this exemplary embodiment, at the second turn, the heat stored in the heating roller 51 to fix the toner image is dissipated through the paper P by a predetermined amount or more, resulting in the temperature of the outer circumferential surface of the heating roller 51 being reduced. To address the situation, at the time when the contact portion in the outer circumferential surface of the heating roller 51 reaches the position of the external heating roller 53, the external heating roller 53 is brought into contact with the heating roller 51, and heat is supplied to the heating roller 51. Thus, the distribution of temperature on the outer circumferential surface of the heating roller 51 may be easily made uniform. That is, the variation in temperature of the outer circumferential surface of the heating roller 51 may be prevented or reduced. In practice, the timing at which the external heating roller 53 is brought into contact with the heating roller 51 may be controlled using time. Thus, the time which is represented by t1 is set, and the external heating roller 53 is brought into contact with the heating roller 51 at the time when t=t1. In other words, the external heating roller 53 may be brought into contact with the heating roller 51 after a predetermined time elapses after the leading end of the paper P in the transport direction thereof enters the nip part N.

Then, the processing unit determines whether or not an amount of time greater than or equal to t2 (t≥t2) has elapsed since the reference time (step 107). If an amount of time greater than or equal to t2 has elapsed, the processing unit performs control to separate the external heating roller 53 from the heating roller 51 (step 108). In this exemplary embodiment, the time t2 may be set as a predetermined time after the leading end of the paper P in the transport direction thereof passes through the nip part N.

Then, the processing unit determines whether or not the subsequent paper P exists (step 109). If no subsequent paper exists (NO in step 109), the fixing process ends. If the subsequent paper P exists (YES in step 109), the process returns to step 104. That is, the control described above is performed each time paper P passes through the nip part N.

In this exemplary embodiment, in step 103, if the toner image to be fixed is black and white (NO in step 103), the processing unit performs the processing of step 110 to step 112 that is similar to the processing of step 104 to step 106 described above. Then, the processing unit determines whether or not the subsequent paper P exists (step 113). If no subsequent paper exists (NO in step 113), the processing unit performs control to separate the external heating roller 53 from the heating roller 51 (step 114). Then, the processing unit ends the fixing process. If the subsequent paper P exists (YES in step 113), the process returns to step 110.

That is, in this exemplary embodiment, if the toner image to be fixed is black and white, the external heating roller 53 is brought into contact with the heating roller 51 after the time t1 has elapsed since the reference time. After that, the external heating roller 53 is not separated from the heating roller 51 until the fixing process ends. In a case where the toner image is composed of a single color, such as when only the black (K color) toner is used, the problem of the difference in glossiness is less likely to occur. In other words, in this exemplary embodiment, the heating roller 51 may control the processing of steps 104 to 109 described above if a toner image composed of multiple colors is fixed.

In this exemplary embodiment, therefore, control is performed to separate the external heating roller 53 from the heating roller 51 after a predetermined time elapses after the trailing end of the paper P in the transport direction thereof passes through the nip part N.

FIGS. 5A to 5D illustrate the changes in temperature of the outer circumferential surface of the heating roller 51 and the outer circumferential surface of the external heating roller 53 when the above predetermined time is changed.

Here, the abscissa represents the processing time after the fixing process is started. The left ordinate represents the temperature of the outer circumferential surface of the heating roller 51, and the right ordinate represents the temperature of the outer circumferential surface of the external heating roller 53. In FIGS. 5A to 5D, the thin lines (represented by HR-C) indicate the changes in temperature of a center portion in the outer circumferential surface of the heating roller 51 in the axial direction of the heating roller 51, and the thick lines (represented by ER-C) indicate the changes in temperature of a center portion in the outer circumferential surface of the external heating roller 53 in the axial direction of the external heating roller 53. The graphs in FIGS. 5A to 5D illustrate that the fixing process has been performed on plural sheets of paper P.

Figure 5A:
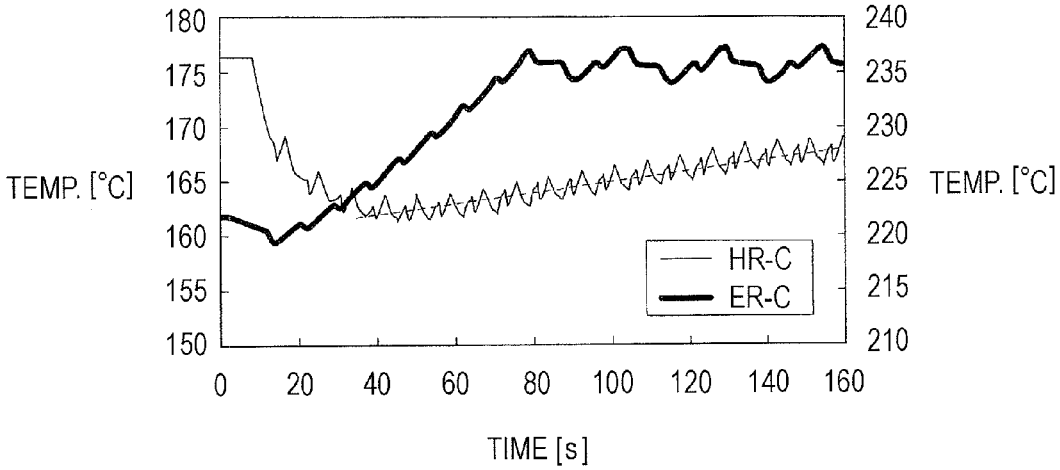
FIGS. 5A to 5D illustrate the changes in temperature of the outer circumferential surface of the heating roller and the outer circumferential surface of the external heating roller.
Figure 5B:
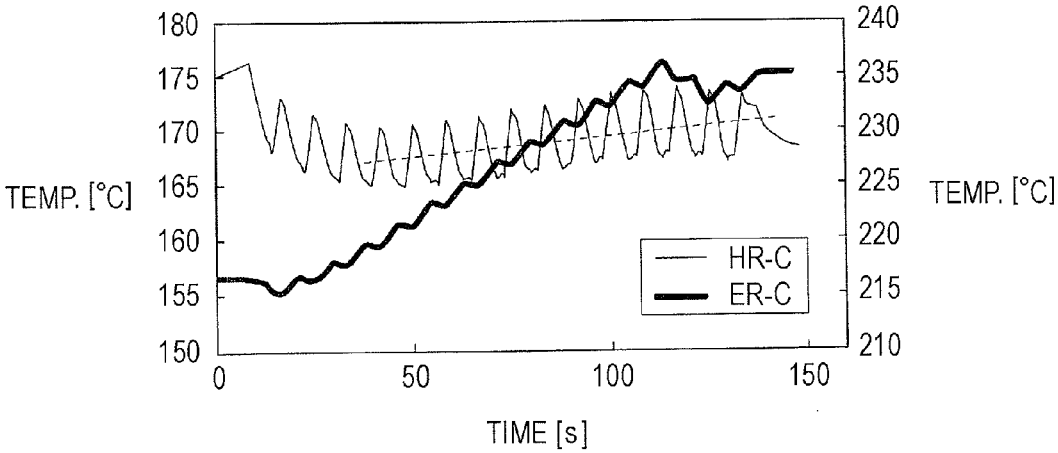
Figure 5C:
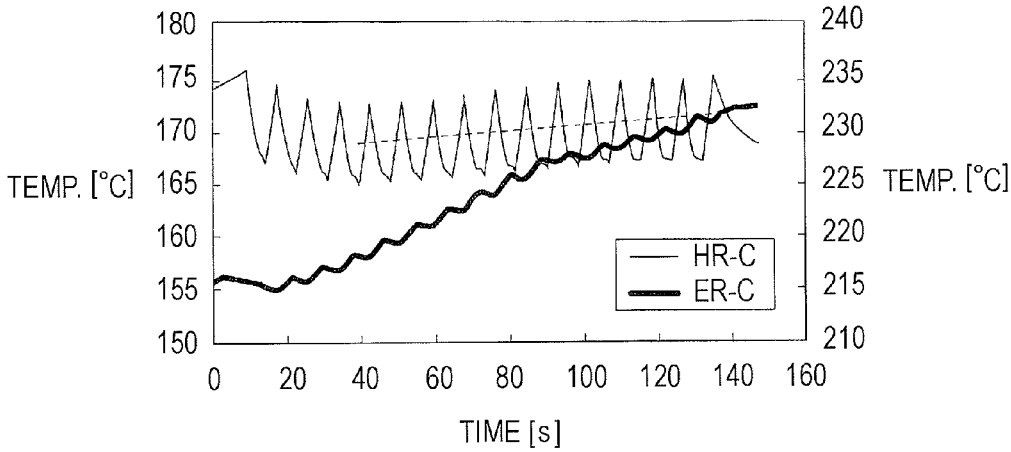
Figure 5D:
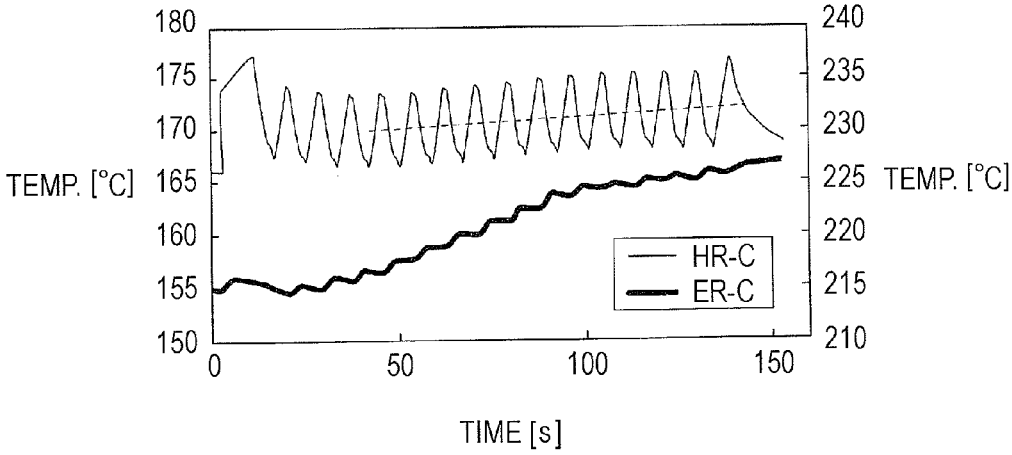

In FIG. 5A, the predetermined time that elapses after the trailing end of the paper P in the transport direction thereof passes through the nip part N is set to 1 s, in FIG. 5B, to 2 s, in FIG. 5C, to 3 s, and in FIG. 5D, to 4 s.

As may be seen from the changes in temperature of the heating roller 51 indicated by the thin lines (HR-C) in FIGS. 5A to 5D, if the time when the external heating roller 53 is separated from the heating roller 51 after the trailing end of the paper P in the transport direction thereof passes through the nip part N is set to 0 s, as indicated by the dotted lines, the temperature of the outer circumferential surface of the heating roller 51 slowly increases in the middle of the fixing process. This means that the fixing process is performed under conditions of slowly increasing temperature. Thus, a difference in glossiness occurs in images formed on sheets of paper P.

If the predetermined time becomes longer, the increase in temperature of the outer circumferential surface of the heating roller 51 is less likely to occur in the middle of the fixing process. In this exemplary embodiment, as illustrated FIG. 5D, the increase in temperature of the outer circumferential surface of the heating roller 51 is least likely to occur if the time when the external heating roller 53 is separated from the heating roller 51 after the trailing end of the paper P in the transport direction thereof passes through the nip part N is set to 4 s.

Figure 6:
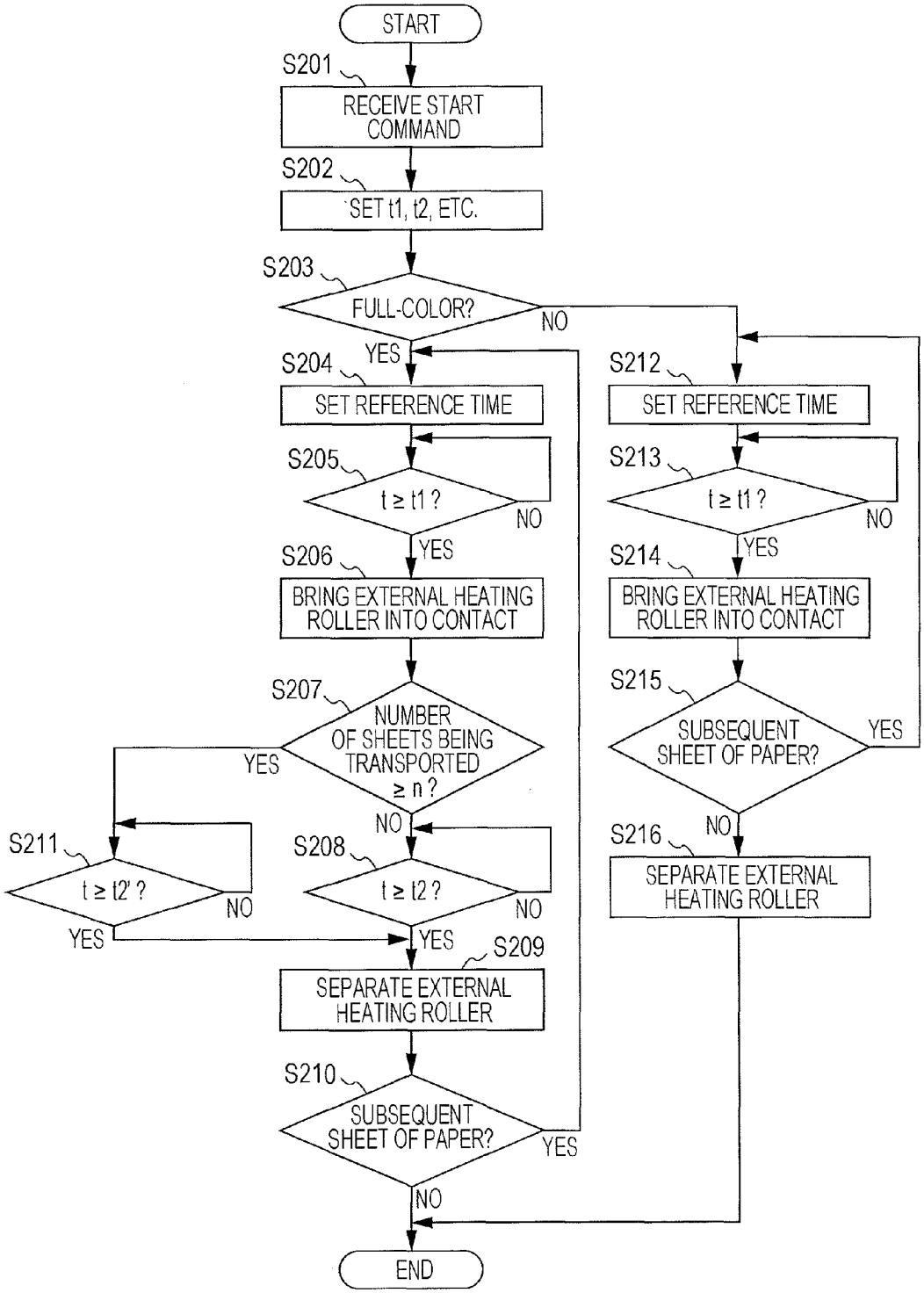
FIG. 6 is a flowchart illustrating a second control example for bringing the external heating roller into contact with the heating roller and separating the external heating roller from the heating roller.

FIG. 6 is a flowchart illustrating a second control example for bringing the external heating roller 53 into contact with the heating roller 51 and separating the external heating roller 53 from the heating roller 51.

Here, the processing of steps 201 to 206 and the processing of steps 212 to 216 is similar to the processing of steps 101 to 106 and the processing of steps 110 to 114 described with reference to FIG. 4, respectively.

In FIG. 6, after step 206, the processing unit determines whether or not the number of sheets being transported, that is, the number of sheets of paper P that have passed the fixing unit 50, is greater than or equal to n ((number of sheets being transported)≥n) (step 207). If the number of sheets being transported is less than n (NO in step 207), the processing of steps 208 to 210 similar to the processing of steps 107 to 109 described with reference to FIG. 5, respectively, is performed. If the number of sheets being transported is greater than or equal to n (YES in step 207), the processing unit determines whether or not an amount of time greater than or equal to t2' has elapsed since the start of the fixing process (t≥t2') (step 211). If an amount of time greater than or equal to t2' has elapsed, the processing unit performs the processing of steps 209 to 210.

That is, in this exemplary embodiment, the time when the external heating roller 53 is separated from the heating roller 51 after the trailing end of the paper P in the transport direction thereof passes through the nip part N is changed from t2 to t2' at the time when the number of sheets being transported becomes greater than or equal to n.

Figures 7A, 7B:
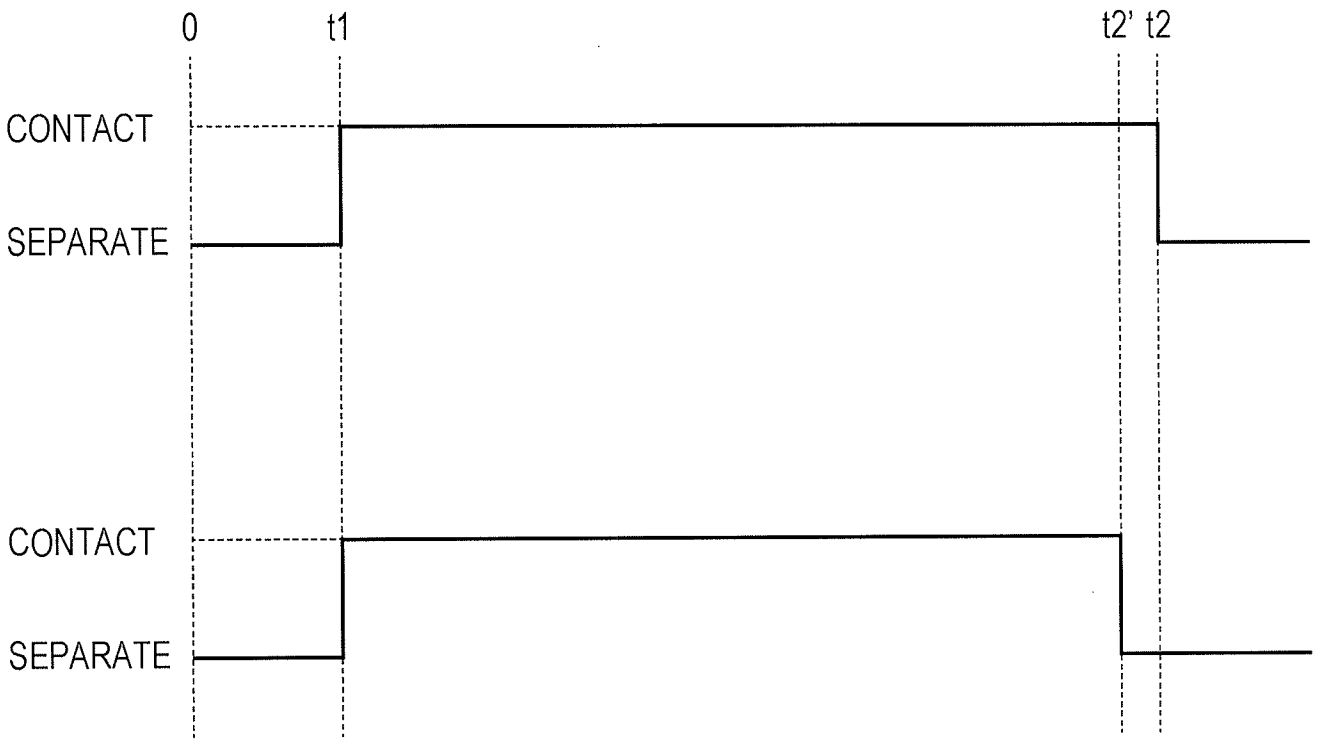
FIGS. 7A and 7B are timing charts illustrating the operation of the external heating roller when the time at which the external heating roller is separated from the heating roller is set to t2 and to t2'.

FIGS. 7A and 7B are timing charts illustrating the operation of the external heating roller 53 when the time of separating the external heating roller 53 from the heating roller 51 is set to t2 and when the time at which the external heating roller 53 is separated from the heating roller 51 is set to t2', respectively.

As illustrated in FIGS. 7A and 7B, in this exemplary embodiment, the external heating roller 53 is separated from the heating roller 51 under the condition where t2>t2'.

Figure 8:
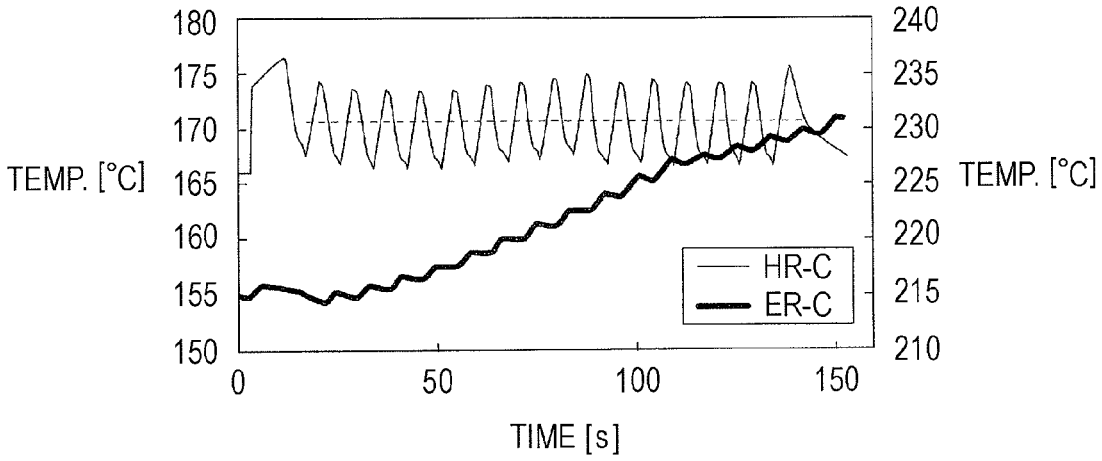
FIG. 8 illustrates the changes in temperature of the outer circumferential surface of the heating roller and the outer circumferential surface of the external heating roller when the time at which the external heating roller is separated from the heating roller is changed from t2 to t2'.

FIG. 8 illustrates the changes in temperature of the outer circumferential surface of the heating roller 51 and the outer circumferential surface of the external heating roller 53 when the above time is changed from t2 to t2'.

In FIG. 8, what the abscissa, the ordinate, the thin line (HR-C), and the thick line (ER-C) represent is similar to that in FIGS. 5A to 5D. FIG. 8 illustrates a case where the number of sheets being transported is greater than or equal to 7 (n=7) and the time when the external heating roller 53 is separated from the heating roller 51 after the trailing end of the paper P in the transport direction thereof passes through the nip part N is changed from 4 s to 3 s.

As illustrated in FIG. 8, the time when the external heating roller 53 is separated from the heating roller 51 after the trailing end of the paper P in the transport direction thereof passes through the nip part N is made short in the middle of the process, thus allowing the changes in temperature of the outer circumferential surface of the heating roller 51 to be further reduced. As indicated by the thick line (ER-C), the temperature of a center portion in the outer circumferential surface of the external heating roller 53 in the axial direction of the external heating roller 53 slowly increases after the start of the fixing operation. Then, the temperature is controlled to a predetermined set temperature in the middle of the fixing process. Therefore, by a predetermined time after the fixing operation is started, the temperature of the outer circumferential surface of the external heating roller 53 is lower than the set temperature. The amount of heat supplied to the heating roller 51 is comparatively small before the temperature of the external heating roller 53 reaches the set temperature. Therefore, the external heating roller 53 may need to be brought into contact with the heating roller 51 for a longer period of time. After the temperature of the outer circumferential surface of the external heating roller 53 has reached the set temperature, however, the amount of heat supplied to the heating roller 51 becomes large. Thus, if the period of time during which the external heating roller 53 and the heating roller 51 are in contact is not changed, the temperature of the outer circumferential surface of the heating roller 51 may gradually increase in the middle of the fixing process. This phenomenon may be prevented or reduced by, as in this exemplary embodiment, separating the external heating roller 53 from the heating roller 51 earlier in the middle of the process.

In the example described above, the time of separating the external heating roller 53 from the heating roller 51 is changed on the basis of the number of sheets being transported, by way of example. However, this is not to be taken in a limiting sense, and the time at which the external heating roller 53 is separated from the heating roller 51 may be changed after a predetermined processing time elapses after the fixing process is started. In this exemplary embodiment, furthermore, the processing unit is provided in the fixing unit 50 by way of example. However, this is not to be taken in a limiting sense, and, for example, the controller 60 may perform a similar process to that performed by the processing unit. In addition, the times t2 and t2' described above may be changed on the basis of the type of the paper P. Paper P that is thick paper may require a larger amount of heat for the fixing process than that for thin paper. Thus, if the paper P is thick paper, the time t2 or t2' may be longer than that for thin paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes a toner image onto a recording material;

a pressing member pressed against an outer circumferential surface of the fixing member to form a fixing pressure part between the pressing member and the fixing member, the fixing pressure part being a part through which a recording material that has an unfixed toner image held thereon passes;

a heating member that heats the outer circumferential surface of the fixing member;

a movement mechanism which moves the heating member to contact with and be apart from the fixing member; and a control unit which controls the movement mechanism to move the heating member relatively apart from the fixing member after a predetermined time elapses after a trailing end of the recording material in a transport direction thereof passes through the fixing pressure part each time when a recording material passes through the fixing pressure part, wherein each time a recording material passes through the fixing pressure part, the control unit controls the movement mechanism to move the heating member into contact with the fixing member after a predetermined time elapses after a leading end of the recording material in the transport direction thereof enters the fixing pressure part.

2. The fixing device according to claim 1, wherein the predetermined time is determined based on at least one of a number of recording materials that have passed through the fixing pressure part, a time that elapses after a predetermined reference time, and a type of a recording material.

3. The fixing device according to claim 1, wherein the fixing member fixes toner images of a plurality of colors.

4. An image forming apparatus comprising:

a toner image forming unit that forms a toner image;

a transfer unit that transfers the toner image formed by the toner image forming unit onto a recording material; and a fixing unit that fixes the toner image transferred by the transfer unit onto a recording material, the fixing unit including a fixing member that fixes a toner image onto a recording material, a pressing member pressed against an outer circumferential surface of the fixing member to form a fixing pressure part between the pressing member and the fixing member, the fixing pressure part being a part through which a recording material that has an unfixed toner image held thereon passes, a heating member that heats the outer circumferential surface of the fixing member, a movement mechanism which moves the heating member to contact with and be apart from the fixing member, and a control unit which controls the movement mechanism to move the heating member relatively apart from the fixing member after a predetermined time elapses after a trailing end of the recording material in a transport direction thereof passes through the fixing pressure part each time when a recording material passes through the fixing pressure part, wherein each time a recording material passes through the fixing pressure part, the control unit controls the movement mechanism to move the heating member into contact with the fixing member after a predetermined time elapses after a leading end of the recording material in the transport direction thereof enters the fixing pressure part.

* * * * *